US005931235A

United States Patent [19]

Weixler

[11] Patent Number: 5,931,235

[45] Date of Patent: Aug. 3, 1999

[54] CUTTER HEAD, BORING JIG AND DEVICE AND PROCESS FOR SEA BOTTOM BORING

[75] Inventor: Leonhard Weixler, Thierhaupten, Germany

[73] Assignee: Bauer Spezialtiefbau GmbH, Thierhaupten, Germany

[21] Appl. No.: 08/895,025

[22] Filed: Jul. 16, 1997

[30] Foreign Application Priority Data

Jul. 16, 1996 [DE] Germany ..... 196 28 661
Sep. 4, 1996 [DE] Germany ..... 196 35 916

[51] Int. Cl.[6] ..... E21B 10/26; E21B 7/12

[52] U.S. Cl. ..... 175/10; 175/391; 175/396

[58] Field of Search ..... 175/10, 391, 385, 175/396, 413, 412, 259

[56] References Cited

U.S. PATENT DOCUMENTS

| | | | |
|---|---|---|---|
| 1,391,626 | 9/1921 | Gilthorpe | 175/391 X |
| 1,524,776 | 2/1925 | Boland et al. | 175/413 X |
| 1,747,908 | 2/1930 | Seifert | 175/391 X |
| 1,826,059 | 10/1931 | Dunn et al. | 175/391 X |
| 2,021,219 | 5/1935 | Bell | 175/391 X |
| 2,049,543 | 8/1936 | Kammerer | 175/413 X |
| 4,049,067 | 9/1977 | Dively | 175/406 |
| 4,682,660 | 7/1987 | Barthelemy et al. | 175/391 X |

*Primary Examiner*—Frank Tsay
*Attorney, Agent, or Firm*—Sixbey, Friedman, Leedom & Ferguson; David S. Safran

[57] ABSTRACT

A cutter head for retrieving earth samples, in particular for taking underwater samples, has, because of frustum-shaped cutting wheels, an approximately round bore cross section. In an associated boring jig, a tube with a cross section corresponding approximately to the bore cross section is placed above the cutter head. With a regrasping system, the tube can be moved vertically relative to a work table lying on the bore surface. The boring jig may be lowered from a ship to the sea bottom to conduct the boring process.

25 Claims, 4 Drawing Sheets

CUTTER HEAD, BORING JIG AND DEVICE AND PROCESS FOR SEA BOTTOM BORING

BACKGROUND OF THE INVENTION

TECHNICAL FIELD

The present invention relates to a cutter head for trial borings, a boring jig for gathering earth samplings in the form of a sea bottom boring jig and a process for sea bottom boring that is used in earth sampling to collect soil samples from a defined depth beneath the bore surface.

BACKGROUND OF THE INVENTION

In the past, for trial borings, louvered slide cutters were used which have two offset pairs of cutting wheels, positioned parallel to the tools axis, which rotate in opposite directions on horizontal axes so that the loosened earth is conveyed to the intermediate space between the two wheels, where it is transported upward by a suction device. These louvered slide cutters include a frame designed for large volumes and consequently are very heavy. The bore cross section formed by the tool is necessarily rectangular and in order to support the borehole, a support fluid must be poured into the bore hole. An example of such a tool is that manufactured under the name Bentonit.

Such louvered slide cutters are not very suitable for earth sampling since the support fluid is filled up to the bore bottom and consequently mixes with the bored earth. A clean analysis of the composition of the bored earth layer is thus not possible. Further, the bore cross sections are unnecessarily large and the rectangular shape of the bore cross section results in only moderate inherent stability of the bore.

While louvered slide cutters of this type are used by supply ships for earth sampling below sea level, the maximum reachable bore depth is limited. Sea bottom sampling such as, e.g., diamond prospecting or the search for other rare materials, thus often requires the use of excavating buckets. However, this process is very imprecise and not particularly efficient.

It is further known to explore the sea bottom with what can be called tubed worms. While this process makes it possible to reach greater bore depths, a boring worm can only be used when boring in relatively soft ground.

Clearly there is a need in the art for a cutter head for trial borings, a boring jig for gathering earth samplings in the form of a sea bottom boring jig and a process for sea bottom boring that may be used in earth sampling to collect soil samples from a defined depth beneath the bore surface and to do so in hard earth material as well.

SUMMARY OF THE INVENTION

A primary object of the present invention is to overcome the aforementioned shortcomings associated with the prior art devices.

Thus an object of the present invention is to provide a cutter head, a boring jig and a sea bottom boring jig, as well as a process for sea bottom boring, that makes it possible to achieve efficient earth sampling to great boring depths even when presented with hard earth material.

This object is achieved in accordance with the present invention by providing a cutter head with at least two coaxial cutting wheels, rotating and running in opposite directions, with the cutting wheel having diameters which taper toward one of the tool to form a substantially round bore cross section. Additionally, in accordance with the present invention, a boring tool that is very well adapted to the particular conditions encountered during earth sampling is achieved.

The boring jig according to the present invention yields a bore sample that precisely reflects the depth placement of the tool and the particular individual materials desired. Additionally, very stable operating conditions are achieved in the borehole as a result of the substantially round bore cross section. Furthermore, the surface area of the borehole wall is minimal compared to the borehole volume. Accordingly, with the borehole shape according to the present invention, high efficiency is achieved, i.e., a high yield of cut material is conveyed.

Although the boring jig in accordance with the present invention can also be used on land, it is especially suited for use as a sea bottom boring jig.

A very good boring result is achieved if the cutter head is designed as a full cut cutter head. Preferably, the cutter head is made of frustum-shaped cutting wheels that turn in opposite directions. This design makes it possible to achieve a circular bore cross section. A result of this boring head design, the boring head exhibits a very high boring efficiency.

A further object of the present invention is to provide a boring head which supports four cutting wheels in pairs on gear plates and to place hydraulic drive motors above the gear plates. Additionally, in order to further increase the bore head's efficiency, reamer plates are provided on the cutter head. The reamer plates aid in grinding the cut material such that the cut material can be ground up by the cutting teeth to defined, maximum particle size. The ground up, cut material can then be extracted through a suction box by a suction line.

A boring jig according to the present invention includes, above the cutter head, a tube with a cross section that corresponds approximately to the bore cross section. Using this tube stabilizes the cutting head and secures the entire bore. The bore cannot cave in or be filled in because of slipping material surrounding the bore, so that a precisely preset ground area with defined volume can be conveyed. The evaluation of such a sample bore is thus especially reliable. Further, by utilizing the bore tube, the cutting head is easily advanced through the bore.

Especially good results are achieved if a cutter head according to the present invention is used in conjunction with a work table that is supported on the bore surface and grasps the tube with a regrasping system for advancing and retracting the tube in a lengthwise direction of the tube. In particular, the work table with the regrasping system exerts a forward-pushing force on the cutter head. This arrangement readily stabilizes the boring jig in a secure manner. Further, when the boring head and the tube are pulled out, the forces occurring in the process are transferred directly to the earth surface around the bore without stressing other components of the device.

To achieve efficient operation and to drain and feed the cutter head a suction line and hydraulic line are each attached integrally within the tube and flushing water may be fed to the cutter head through the tube. This advantageous use of the area surrounding the boring head guarantees a quick and reliable carrying away of the cut material. Further, a lasting facilitation of the cutting conditions is achieved by the reliable outflow of loosened earth. The design of the tube, which is made of for example made of steel or plastic, protects the tool from damage which may otherwise be caused by contact with sharp-edged projections of the bored earth which are created during the boring process.

Since the most beneficial area for earth sampling often does not lie directly under the earth's surface, an advantageous simplification of the boring operation is achieved by providing a bypass valve on the top end of the tube through which unwanted cut material can be pumped out of the suction line. This saves the expense of pumping the unwanted cut material through the entire suction line up to the supply ship.

An advantageous application of the sea bottom boring jig is guaranteed by mounting it on a ship with a work turret placed above an opening positioned amidship. The part of the sea bottom boring jig that can be lowered, which consists mainly of the cutter head, work table and tube, can be retracted and deployed through the opening. The tube that has been pulled up can be fastened securely in a vertical orientation, in the work turret.

Good boring operation is achieved by running lines through the top opening of the tube to the cutter head, by way of guide devices on the work table, for the operation of the sea bottom boring jig. This makes it possible to stretch these lines relatively tautly with minimum length and to avoid the affects of the sea current, without an undesired force being exerted by these lines upward on the boring head and the tube. The lines exert a force only upward on the work table, which because of its weight, does not experience any disruption in its orientation. Advantageous operation is further made possible by providing a rope guided over rollers that connects the ship, the work turret, a sliding guide part surrounding the tube and the work table, to lower and raise the sea bottom boring jig. In doing so, rapid and precise boring is achieved.

In an especially advantageous way, the vertical orientation of the tube can be maintained by the guide part if the rope is held constantly at a relatively high tension. As already described above, the work table, because of its great weight, can be subjected to relatively high, upward-oriented forces without its orientation being impaired.

In accordance with the present invention, the aforementioned objects are achieved by lowering the part of the sea bottom boring jig that consists mainly of the cutter head, the work table and the tube through the opening amidship, on the rope, from the recovery winch on the ship to the sea bottom, with the work table being located on the bottom end of the tube; boring into the sea bottom with the cutting head with the regrasping system subsequently advancing the tube downward; conveying the cut material up to the ship by a suction line; and after the boring operation is finished, using the regrasping system to pull the tube up and out of the borehole. The part of the sea bottom boring jig that can be lowered subsequently pulled up again to the ship using the recovery winch on the ship.

Thus, a sea bottom sampling system is provided that can convey large volumes of sea bottom samples in a simple and fast way. Because of the process, relatively great boring depths are possible, especially since the bore is secured through the tube and a secure orientation is provided by the heavy work table which is positioned on the sea bottom. During the boring process, unwanted cut material may be removed by the bypass valve on the top end of the tube out of the suction line without having to pump the unwanted material up to the supply ship.

In overall operation, the boring head is reliably manipulated through the tube in that large amounts of follow-up sea water as flushing water for the cutting operation is delivered to the cutting head.

These as well as additional objects of the present invention will become apparent form the following detailed description when read in light of the several figures.

DETAILED DESCRIPTION OF THE PRESENT INVENTION

Figure 1:
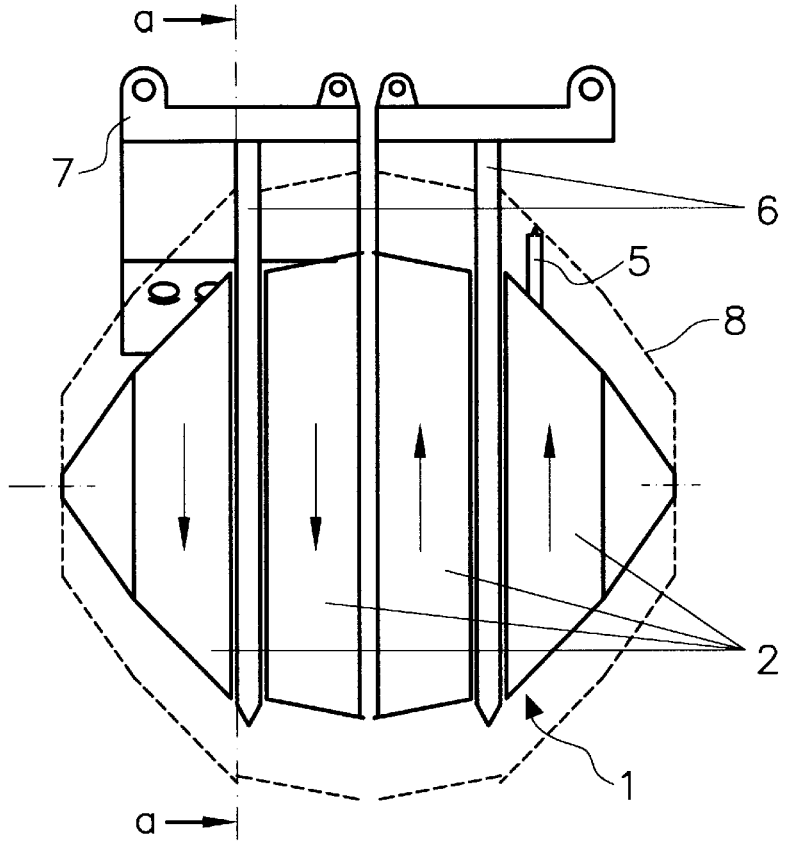
FIG. 1 is a side cross sectional view of a boring head in accordance with the present invention.

With reference now to the several figures, FIG. 1 shows a cutter head 1 having a substantially round bore cross section. The cutter head 1 is preferably formed of four frustum-shaped cutting wheels 2 running in pairs in opposite directions, as shown by the arrows, and are supported in pairs by two gear plates 6. The radii of the frustums become smaller in an axial direction from the axial center of the cutter head 1 outwardly. The cutting wheels 2 positioned axially on the outside of the cutter head 1 have a smaller diameter than the inner cutting wheels 2. The cutting wheels positioned on the outside of the cutter head 1 are formed from a first frustum, positioned axially inside a second frustum, which is flatter than the cone from which the frustums of the inner cutting wheels 2 are derived with the second frustum being a smaller frustum, lying axially outside the first frustum, which is of a still flatter cone whose small surface that forms the axial end is considerably smaller than the greatest diameter of cutter head 1.

Figure 3:
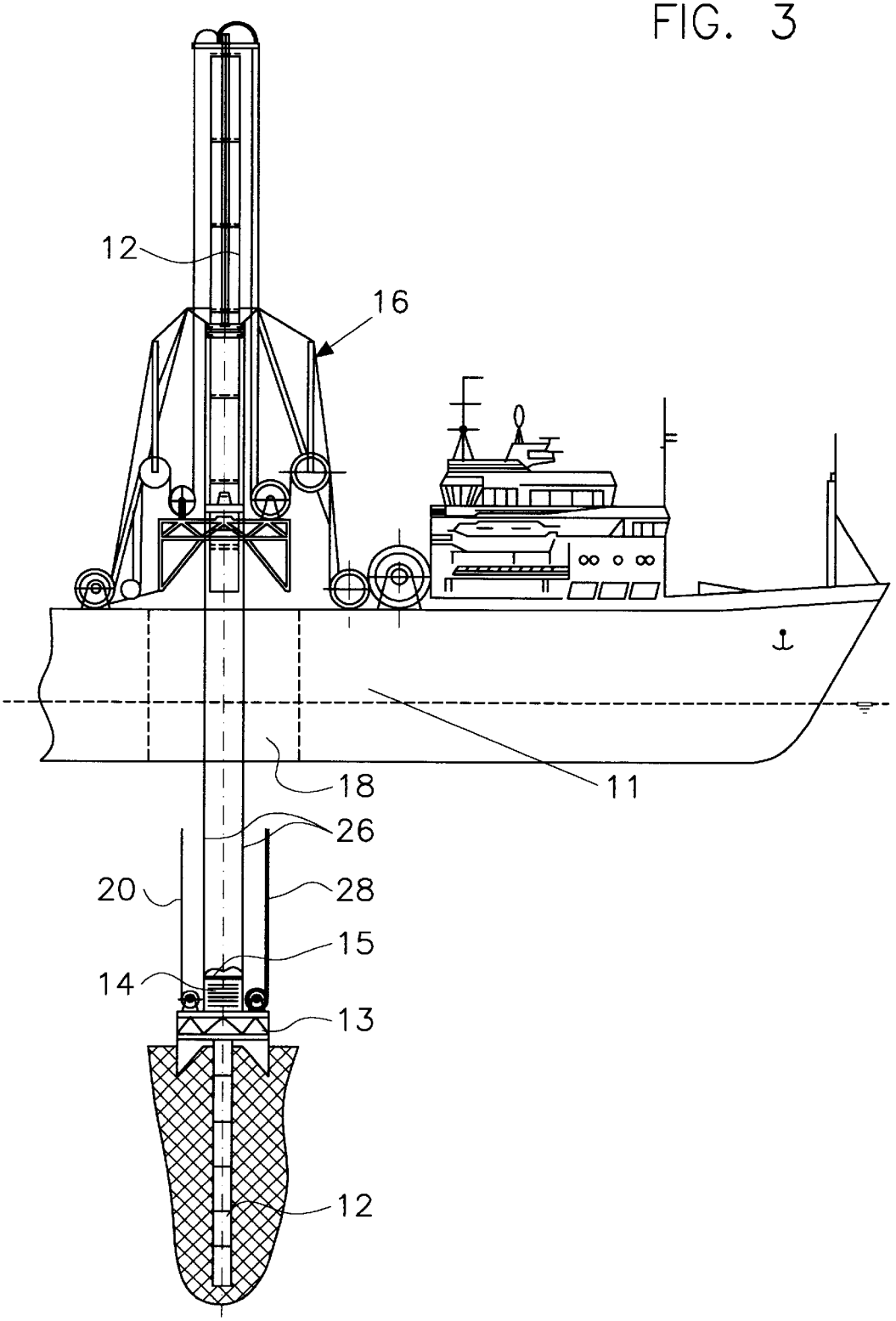
FIG. 3 is a side view of a supply ship illustrating the boring jig in accordance with the present invention in both the raised position and the lowered position with a cross section of the sea bottom of the part of the lowerable sea bottom boring jig according to the present invention during the boring operation.

The drive motors for the cutting wheels 2 (not shown) are positioned adjacent to and above the cutting wheels 2. The gear plates 6 are attached to a frame 7 that is placed on the end of a tube 12 (FIG. 3). As noted above, the cutting wheels 2 run in pairs in opposite directions. Each pair of cutting wheels 2 are driven by a gear similar to that shown in EP 0 167 090. A torque occurring around the bore axis is compensated for by the firm supporting of tube 12 in the circumferential direction within the bore. Cutting teeth 5 are positioned about the circumference of cutting wheels 2, spaced evenly from one another in the circumferential direction, which enlarges the working area of the cutter head 1 out to dashed delimitation lines 8 as shown in FIG. 1.

Figure 2:
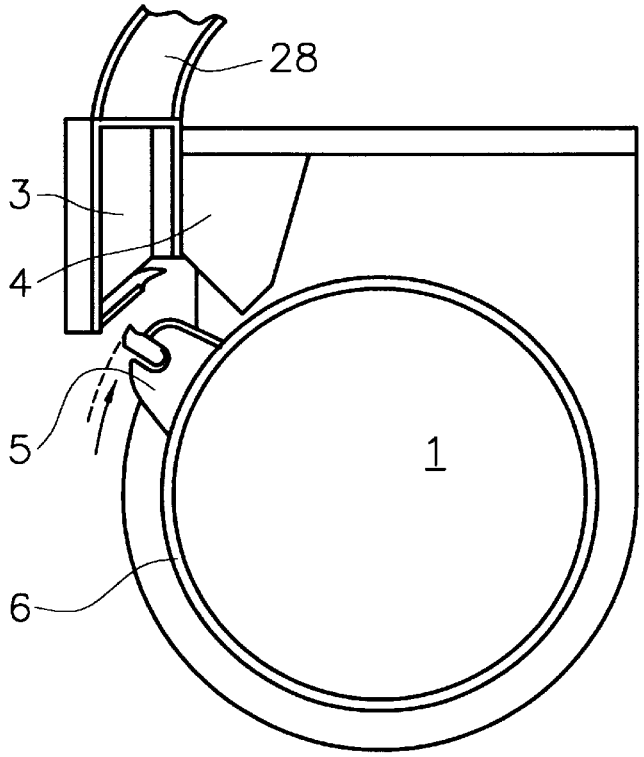
FIG. 2 is a lengthwise side view of a boring head in accordance with the present invention taken along line a—a of FIG. 1.

For clarity, only a single cutting tooth 5 is illustrated as an example in FIGS. 1 and 2. FIG. 2 further shows a reaming plate 4 that grinds the cut material to a defined maximum particle size. The now cut and ground material is sectioned off through a suction box 3 and a suction line 28.

The environment to which the present invention is. most readily adapted is illustrated in FIG. 3. As FIG. 3 shows, a ship 11 is provided as an above-water device for conducting the boring operation. The ship preferably includes a work turret 16 amidship that is placed above an opening 18 in the ship bottom. The portion of the sea bottom boring jig which is to be lowered is lowered on a rope 26 through this opening 18 to a predetermined position. This portion of the sea bottom boring jig includes the cutter head 1 (not shown in FIG. 3), tube 12 and a work table 13. FIG. 3 shows this part in both the idle position and in the work position, namely in the raised position, where tube 12 is fixed in a vertical orientation in work turret 16 and in a lowered predetermined position, where tube 12, by a regrasping system 14, is pushed down relative to work table 13 to the maximum bore depth.

The regrasping system 14 consists of hydraulically driven clamps that are adjustable in the radial direction and in the axial direction of tube 12. The clamps grab onto the circumference of tube 12 and move it in the axial direction. The clamps are pressed with the hydraulic drive in the radial direction against tube 12 so that they are securely pressed against the circumference of tube 12 without being able to slip relative to the tube 12. The clamps are distributed around the tube circumference approximately evenly so that no resulting moment acts in the radial direction on tube 12. To move tube 12, the clamps are hydraulically driven in the axial direction of tube 12, causing them to take tube 12 along with them and to shift it relative to work table 13. If tube 12 is to be shifted relative to work table 13 further than the maximum lift of the clamps in the axial direction, the clamps loosen themselves from tube 12 when the maximum lift in the axial direction is reached, are then moved back in the opposite direction and then grip tube 12 again by a movement in the radial direction. Then the clamps carry tube 12 along with them again in the desired direction of movement.

The tube 12 has a diameter that corresponds to the bore diameter of the cutter head 1. During the boring operation, the force transmitted by the regrasping system from work table 13 to tube 12 in the axial direction of tube 12 acts as the force to advance the cutter head 1. In particular with sea bottom boring, tube 12 results in improved boring conditions since, due to the extremely free-flowing components of the sea bottom, the bore is always subjected to the danger of filling up due to collapsing of the side walls. Since tube 12 has no projections and relatively flat walls, its insertion into the bore is possible with a relatively small exertion of force. The cutter head 1 is held by tube 12 in a straight boring direction. This makes it possible to conduct sample bores in precisely defined areas. The cutter head 1 and tube 12 are integrally connected to one another. The tube 12 thus also fulfills a support function for cutter head 1. The tube cross section is matched to the approximately circular bore cross section of cutter head 1. Because of this cross section shape, the stability of tube 12 against caving in or buckling is very high.

On the top end of tube 12 there is a bypass valve 15 through which unwanted cut material can be pumped out of suction line 28. This bypass valve 15 makes it possible, for example, to empty the cut material that was bored in the first section of the bore and to raise to ship 11 only the cut material that comes from a deeper bore depth. After the end of the boring operation tube 12, with cutter head 1, is again raised relative to work table 13 by regrasping system 14. Typical retraction forces are on the order of 500 to 1,000 tons. But the latter are not introduced into rope 26 between ship 11 and work table 13. Only after tube 12 has been raised completely relative to work table 13 is the rope 26 wound up by a recovery winch 25 (see FIG. 6) on the ship.

Figure 4:
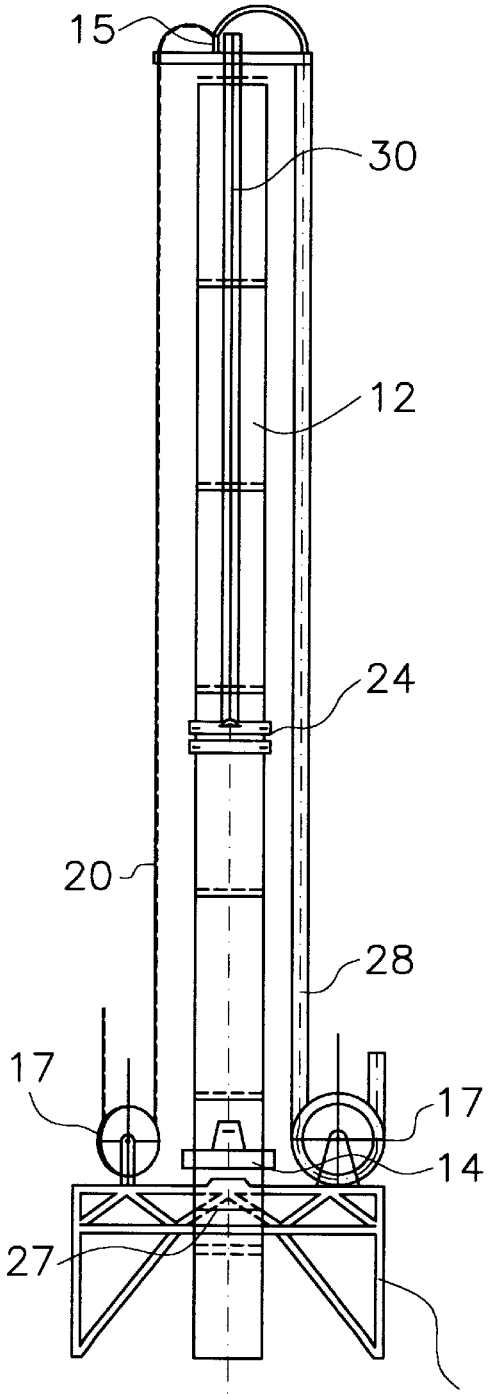
FIG. 4 is a side view of the potion of the sea bottom boring jig in accordance with the present invention which is lowered in the manner illustrated in FIG. 3.
Figure 5:
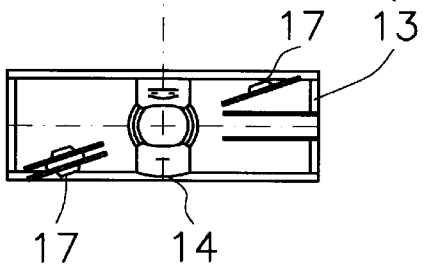
FIG. 5 is a top view of the lowerable portion of sea bottom boring jig in accordance with the present invention.

Referring now to FIGS. 4 and 5, the tube 12 on whose lower end cutter head 1 (not represented) is located is connected to work table 13 by regrasping system 14. The tube diameter typically is about 2 meters and the tube length is generally a maximum of about 30 meters with the weight of work table 13 being about 120 tons. It should be appreciated the both larger and smaller dimensions can also be embodied with departing from the spirit and scope of the present invention. The work table 13 and the tube 12 are connected to one another by a universal suspension 27, such that the boring jig can conduct a vertical bore even when positioned on a slanted sea bottom. A hydraulic line 20 and suction line 28 run from the cutter head 1 upward through the inside of tube 12, out of tube 12 on its upper end, then parallel to tube 12 downward to guide devices that consist of guide rollers 17 attached to work table 13, and then again up to ship 1 1. the tube 12 also forms a conduit for flushing water to supply flushing water to the cutter head 1. The hydraulic line 20 and suction line 28 are preferably metal tubes inside the tube 12 and on the semicircle-shaped guide parts on the top end of the tube, so as to reduce their susceptibility to torsion. Inside the upper part of tube 12 there is also a height adjustment 30 for a guide part 24 that surrounds tube 12.

Figure 6:
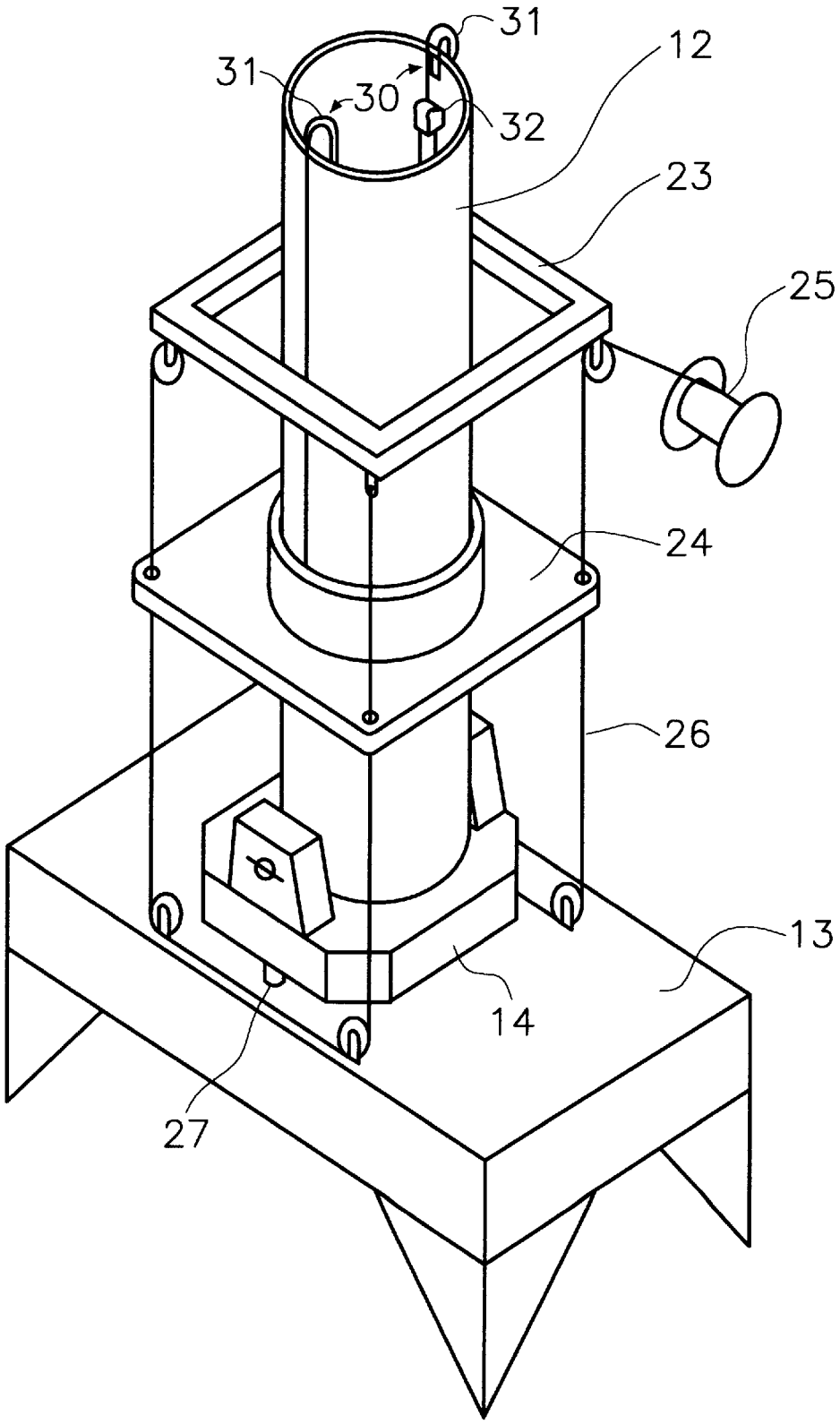
FIG. 6 is a perspective view of the portion of the sea bottom boring jig illustrating the lowering and raising mechanism in accordance with the present invention.

As FIG. 6 shows, rope 26 runs from the recovery winch 25 on the ship, over a roller on a work turret top part 23 on the ship, through an opening of guide part 24, to two rollers on work table 13, then it goes again through guide part 24 to work turret top part 23 on the ship, then again to work table 13 and finally again back to work turret top part 23 that is on the ship and to which the rope end is attached. During the boring operation on the sea bottom, the distance between work table top part 23 on the ship and guide part 24 is greatly increased relative to that represented in FIG. 6. For example, the device works at a water depth of up to about 200 to 300 meters. This distance then corresponds also to the distance between work turret top part 23 on the ship and guide part 24.

The guide part 24 is adjustable in height relative to tube 12 by height adjustment 30. The height adjustment 30 is used to lower the guide part 24 when the tube 12 is completely raised up in the work turret 16. In the fully raised position, tube 12 exceeds the height of work turret 16 and thus also the height of work turret top part 23 on the ship, so that guide part 24 can no longer be located on the top end of tube 12. When tube 12 is lowered, guide part 24 is generally as far up on tube 12 as possible to achieve a good vertical guiding for tube 12 with the rope 26 being under relatively high tension. The height adjustment 30 consists of two diametrically opposed guide rollers 31 on the top edge of tube 12. Driven winches 32 (only one winch 32 is illustrated) are placed inside the tube 12, near the top edge, under both guide rollers. A rope extends from the winches over guide roller 31 downward on the outside of tube 12 to an attachment point on guide part 24 and lying in each case next to tube 12. The guide part 24 is shifted in the axial direction relative to tube 12 by the rolling up and letting out of the rope by height adjustment 30.

The operation of the above described sea boring jig will now be described in detail hereinbelow.

The ship 11 travels over a point on the sea bottom that is to be sampled. During the trip the sea bottom boring jig is in the raised position and located in the work turret 16. When the ship 11 has stopped and is aligned vertically with the area to be sampled, the part of the sea bottom boring jig that is to be lowered is lowered through the opening 18 from work turret 16 into the water down to the sea bottom. The work table 13 is located during this operation on the lower end of tube 12. Thus, the work table 13 reaches the sea bottom first and assumes a stable orientation because of its substantial weight.

The rope 26, hydraulic line 20 and suction line 28 are stretched between the ship 11 and the lowered portion of the boring jig. The rope 26 runs along the tube 12 through the guide part 24 which, after tube 12 has left the work turret 16, is moved to the top end of tube 12. In doing so, because of the relatively tautly stretched rope 26, a vertical orientation of tube 12 is maintained by the guide part 24. The rope 26 can be stretched relatively tautly without the heavy work table 13 being lifted. With an uneven sea bottom, even if work table 13 is lying at a slant, a vertical orientation of tube 12 can be maintained, since both these parts are connected with universal suspension 27.

Next the actual boring operation is conducted by moving the cutting wheels 2 in the turning direction. The cutting wheels 2 rotate in pairs in opposite directions. The cut material is grasped by cutting teeth 5 and ground up by the cooperation of the reaming plates 4. The ground up cut material is withdrawn through the suction box 3 and suction line 28 and raised to ship 11. There it is collected and analyzed.

The advance of the bore of cutter head 1 into the sea bottom is effected by the regrasping system 14 on work table 13, which pushes tube 12 downward in accordance with the speed of the bore advance. During the boring operation, drive energy is transmitted to the cutter head 1 by the hydraulic line 20 and sea water is fed through tube 12 for flushing the bored area. Optionally, a part of the cut material can be removed through the bypass valve 15 on the top end of tube 12 out of the suction line 28 without having to be raised to ship 11. The maximum bore depth is established by the length of the tube 12. If the tube 12 is grasped by the regrasping system 14 on its top end, the maximum bore depth is reached and the tube 12 is again pushed upward by the regrasping system 14. Afterward, the part of the sea bottom boring jig that can be lowered is raised by rope 26 again to the ship 11 into work turret 16. The boring operation is ended and ship 11 can leave the boring site.

Accordingly, as can be appreciated from the foregoing description, the boring jig according to the present invention yields a bore sample that precisely reflects the depth placement of the tool and the particular individual materials desired. Additionally, very stable operating conditions are achieved in the borehole as a result of the substantially round bore cross section. Furthermore, the surface area of the borehole wall is minimal compared to the borehole volume. Accordingly, with the borehole shape according to the present invention, high efficiency is achieved, i.e., a high yield of cut material is conveyed with this cut material being only that material intended to be conveyed.

While the present invention has been described with reference to a preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

I claim:

1. A cutter head comprising:

at least two coaxial cutting wheels rotating in opposite directions; and at least one cutting tooth extending substantially radially from each of said cutting wheels;

wherein a diameter of each of said cutting wheels tapers to one side to form a cutter head having an approximately round cross section;

a pair of gear plates for supporting said cutting wheels;

wherein four cutting wheels are supported in pairs, each pair of said cutting wheels being supported by one of said gear plates.

2. The cutter head according to claim 1, wherein each of said cutting wheels are frustum-shaped cutting wheels.

3. The cutter head according to claim 1, further comprising at least one drive motor positioned adjacent said gear plates for driving said cutting wheels.

4. The cutter head according to claim 1, further comprising reaming plates associated with each of said cutting wheels for interacting with said cutting teeth for grinding cut material to a defined, maximum particle size.

5. The cutter head according to claim 4, further comprising a suction box and suction line for transferring the cut material to a collection receptacle.

6. A boring jig for boring a bore into a surface, the boring jig comprising:

a cutter head for supporting at least one cutting wheel, said cutter head including at least two coaxial cutting wheels rotating in opposite directions and at least one cutting tooth extending substantially radially from each of said cutting wheels, wherein a diameter of each of said cutting wheels tapers to one side to form a cutter head having an approximately round cross section; and an elongated tube positioned above said cutter head, said tube having a cross section corresponding approximately to a bore cross section of the bore, said tube being extendable into the bore for supporting bore sidewalls defining the bore;

a pair of gear plates for supporting said cutting wheels;

wherein four cutting wheels are supported in pairs, each pair of said cutting wheels being supported by one of said gear plates.

7. The boring jig according to claim 6, wherein each of said cutting wheels are frustum-shaped cutting wheels.

8. The boring jig according to claim 6, further comprising at least one drive motor positioned in said cutter head adjacent said gear plates for driving said cutting wheels.

9. The boring jig according to claim 6, further comprising a suction box and suction line for transferring the cut material to a collection receptacle.

10. A process for sea bottom boring with a sea bottom boring jig comprising the steps of:

providing a sea bottom boring jig including a cutter head for supporting at least one cutting wheel, an elongated tube positioned above said cutter head and a work table for supporting said cutter head and said tube, said tube having a cross section corresponding approximately to a bore cross section, said tube being extendable into the bore for supporting the bore sidewalls;

lowering a portion of the boring jig including the cutter head, a work table and a tube from an initial position to a predetermined position, boring into the sea bottom with said cutter head to form a borehole;

advancing said tube in conjunction with an advancement of said cutter head into the borehole;

conveying cut material to a receptacle by a suction line;

retracting said tube and said cutter head from the borehole; and raising the portion of the boring jig including the cutter head, the work table and the tube to the initial position after the tube and cutter head have been retracted from the borehole.

11. The process for sea bottom boring according to claim 10, further comprising the step of removing unwanted cut material cut from said suction line by a bypass valve positioned on a top end of said tube.

12. The process for sea bottom boring according to claim 11, Further comprising feeding sea water to said cutter head through said tube during the boring process.

13. A cutter head comprising:

at least two coaxial cutting wheels rotating in opposite directions; and at least one cutting tooth extending substantially radially from each of said cutting wheels;

wherein a diameter of each of said cutting wheels tapers to one side to form a cutter head having an approximately round cross section;

reaming plates associated with each of said cutting wheels for interacting with said cutting teeth for grinding cut material to a defined, maximum particle size.

14. The cutter head according to claim 13, further comprising a suction box and suction line for transferring the cut material to a collection receptacle.

15. A boring jig for boring a bore into a surface, the boring jig comprising:

a cutter head for supporting at least one cutting wheel; and an elongated tube positioned above said cutter head, said tube having a cross section corresponding approximately to a bore cross section of the bore, said tube being extendable into the bore for supporting bore sidewalls defining the bore;

wherein said cutter head includes at least two coaxial cutting wheels rotating in opposite directions; and at least one cutting tooth extending substantially radially from each of said cutting wheels;

wherein a diameter of each of said cutting wheels tapers to one side to form a cutter head having an approximately round cross section;

reaming plates associated with each of said cutting wheels for interacting with said cutting teeth for grinding cut material to a defined, maximum particle size.

16. The boring jig according to claim 15, further comprising a bypass valve positioned adjacent a top end of said tube;

wherein unwanted cut material is pumped out of said suction line at said bypass valve.

17. The boring jig according to claim 15, further comprising a suction box and suction line for transferring the cut material to a collection receptacle.

18. A boring jig for boring a bore into a surface, the boring jig comprising:

a cutter head for supporting at least one cutting wheel; and an elongated tube positioned above said cutter head, said tube having a cross section corresponding approximately to a bore cross section of the bore, said tube being extendable into the bore for supporting bore sidewalls defining the bore;

wherein said cutter head includes at least two coaxial cutting wheels rotating in opposite directions; and at least one cutting tooth extending substantially radially from each of said cutting wheels;

wherein a diameter of each of said cutting wheels tapers to one side to form a cutter head having an approximately round cross section;

a work table for supporting said cutter head and positioned on a bore surface, said work table including a regrasping means for adjusting the relative position of said tube with respect to said work table in the bore direction.

19. The boring jig according claim 18, further comprising a suction line and a hydraulic line, for removing cut material from said cutter head and supplying said cutter head with drive energy, said suction line and said hydraulic line extending through said tube.

20. The boring jig according to claim 19, further comprising means for supplying said cutter head with flushing water through said tube for flushing the cutter head within the bore.

21. The boring jig according to claim 18, wherein the boring jig is a sea bottom boring jig.

22. The boring jig according to claim 21, wherein the boring jig is mounted on a ship having a work turret positioned over an opening located amidship, and the cutter head if the boring jig is raised and lowered through said opening.

23. The boring jig according to claim wherein lines for operating the boring jig and running from the ship extend through a top opening of the tube to said cutter head are conveyed by guide means attached to said work table for guiding the lines.

24. The boring jig according to claim 23, wherein a rope is guided over rollers for connecting the ship, the work turret, a movable guide part that surrounds the tube and the work table to one another.

25. The boring jig according to claim 24, wherein the rope extending between the guide tube and the guide part is maintained under tension.

* * * * *